US007622902B1

(12) United States Patent
Kao et al.

(10) Patent No.: US 7,622,902 B1
(45) Date of Patent: Nov. 24, 2009

(54) LOW DROP OUT REGULATOR WITH OVER-CURRENT PROTECTION

(75) Inventors: Shun-Hau Kao, Taipei County (TW); Mao-Chuan Chien, Taipei County (TW)

(73) Assignee: Advanced Analog Technology, Inc., Hsinchu (TW)

( * ) Notice: Subject to any disclaimer, the term of this patent is extended or adjusted under 35 U.S.C. 154(b) by 0 days.

(21) Appl. No.: 12/272,719

(22) Filed: Nov. 17, 2008

(30) Foreign Application Priority Data

Sep. 25, 2008 (TW) ..... 97136828 A

(51) Int. Cl.
*G05F 1/40* (2006.01)

(52) U.S. Cl. ..... 323/276; 323/277; 323/280

(58) Field of Classification Search ..... 323/273–277, 323/279, 280
See application file for complete search history.

(56) References Cited

U.S. PATENT DOCUMENTS 6,201,375 B1 * 3/2001 Larson et al. ..... 323/277
6,972,546 B2 * 12/2005 Kobayashi ..... 323/285
7,501,805 B2 * 3/2009 Chen et al. ..... 323/282
7,508,176 B2 * 3/2009 Hartular et al. ..... 323/273

* cited by examiner

*Primary Examiner*—Jessica Han
(74) *Attorney, Agent, or Firm*—Winston Hsu

(57) ABSTRACT

An LDO with over-current protection includes a first and a second P-type transistor, a sensing resistor, a comparator, and an error amplifier. The channel aspect ratio of the first P-type transistor is much higher than that of the second P-type transistor. The first P-type transistor generates output voltage source according to input voltage source and current control signal. The sensing resistor is coupled among the input voltage source, the second P-type transistor, and the comparator, providing a sensing voltage. The comparator generates a current limiting signal according to first reference voltage and the sensing voltage. When the current limiting signal enables the error amplifier, the error amplifier adjusts voltage of the current control signal according to second reference voltage and voltage divided from the output voltage source; when the current limiting signal disables the error amplifier, voltage of the current control signal is not adjusted.

8 Claims, 2 Drawing Sheets

LOW DROP OUT REGULATOR WITH OVER-CURRENT PROTECTION

BACKGROUND OF THE INVENTION

1. Field of the Invention

The present invention relates to a Low Drop-Out (LDO) regulator, and more particularly, to an LDO regulator with over-current protection.

2. Description of the Prior Art

Please refer to FIG. 1. FIG. 1 is a diagram illustrating a conventional LDO regulator 100. As shown in FIG. 1, the LDO regulator 100 comprises a sensing resistor $R_{REF}$, a reference resistor $R_{REF}$, two feedback resistors $R_{FB1}$ and $R_{FB2}$, a reference current source $I_{REF}$, a comparator CMP, an error amplifier EA, and a transistor $Q_1$. The transistor $Q_1$ is a P channel Metal Semiconductor (PMOS) transistor.

The LDO regulator 100 is used to convert an input voltage source $V_{IN}$ to an output voltage source $V_{OUT}$, for providing the output voltage source and a loading current $I_{LOAD}$ to the load X. The detail of operation principles of the LDO 100 is explained as follows.

The feedback resistors $R_{FB1}$ and $R_{FB2}$ are coupled between the output voltage source $V_{OUT}$ and a ground end for providing the feedback voltage $V_{FB}$ divided from the output voltage source $V_{IN}$ to the error amplifier EA. The error amplifier EA comprises a positive input end for receiving the feedback voltage $V_{FB}$, a negative input end for receiving a reference voltage $V_{REF2}$, and an output end for outputting the current control signal $V_A$ according to the signal received on the positive and negative input ends of the error amplifier EA. The control end (gate) of the transistor $Q_1$ is coupled to the output end of the error amplifier EA for receiving the current control signal $V_A$. The transistor $Q_1$ controls the output voltage source $V_{OUT}$ and the loading current $I_{LOAD}$ according to the magnitude of the current control signal $V_A$. More particularly, when the current control signal $V_A$ is lower, the loading current $I_{LOAD}$ is higher; otherwise, when the current control signal $V_A$ is higher, the loading current $I_{LOAD}$ is lower. Therefore, when the feedback voltage $V_{FB}$ is lower than the reference voltage $V_{REF2}$ (for example, when the loading current drained by the load X increases), the current control signal $V_A$ outputted from the error amplifier EA turns on the transistor $Q_1$ more for raising the output voltage $V_{OUT}$. In other words, the voltage of the current control signal $V_A$ is decreased.

The reference resistor $R_{REF}$ is coupled between the input voltage source $V_{IN}$, the reference current source $I_{REF}$, and the positive input end of the comparator CMP for providing a reference voltage $V_{REF1}$ to the comparator CMP. The sensing resistor $R_{SEN}$ is coupled between the input voltage source $V_{IN}$ and the negative input end of the comparator CMP for providing a sensing voltage $V_{SEN}$ to the operational amplifier. The comparator CMP generates a current limit control signal $S_C$ by comparing the magnitudes of the reference voltage $V_{REF1}$ and the sensing voltage $V_{SEN}$. That is, when the sensing voltage $V_{SEN}$ is higher than the reference voltage $V_{REF1}$, the current limit control signal $S_C$ is logic "0" (low voltage level); otherwise, when the sensing voltage $V_{SEN}$ is lower than the reference voltage $V_{REF1}$, the current limit control signal $S_C$ is logic "1" (high voltage level). Since the sensing resistor $R_{SEN}$ is serial-connected between the input voltage source $V_{IN}$ and the transistor $Q_1$, the magnitude of the loading current $I_{LOAD}$ is limited by the comparator CMP according to the values of the sensing voltage $V_{SEN}$ and sensing resistor $R_{SEN}$. More particularly, when the sensing voltage $V_{SEN}$ is lower than the reference voltage $V_{REF1}$, which means the loading current $I_{LOAD}$ is higher than the current limit $I_{LIMIT}$, the comparator CMP outputs the current limit signal $S_C$ with logic "1" to the error amplifier EA for stopping the error amplifier EA operating. In other words, when the current limit control signal $S_C$ is logic "1", the error amplifier is disabled to keep lowering the voltage of the current limit control signal $V_A$. In this way, the level of the transistor $Q_1$ turned on is limited, which limits the magnitude of the loading current $I_{LOAD}$.

However, since the sending resistor $R_{SEN}$ and the transistor $Q_1$ are connected in series, consequently, the equivalent impedance between the input voltage source $V_{IN}$ and the output voltage source $V_{OUT}$ is increased because of existence of the sensing resistor $R_{SEN}$, causing more power waste and increasing the minimal voltage difference of the input voltage source and the output voltage source of the LDO regulator 100, and therefore the efficiency of the LDO regulator is decreased.

SUMMARY OF THE INVENTION

The present invention provides a Low Drop-Out (LDO) regulator with over-current limit. The LDO regulator comprises a first transistor with a first channel aspect ratio, a sensing resistor, a second transistor with a second channel aspect ratio, a comparator, and an error amplifier. The first transistor comprises a first end coupled to an input voltage source, a second end for generating an output voltage source, and a control end for receiving a current control signal to control current of the output voltage source generated from the second end of the first transistor. The sensing resistor is coupled to the input voltage source. The second transistor comprises a first end coupled to the sensing resistor, a second end, coupled to the second end of the first transistor, and a control end for receiving the current control signal. The comparator comprises a positive input end for receiving a first reference voltage, a negative input end coupled to the sensing resistor for receiving a sensing voltage, and an output end for outputting a current limit control signal according to signals received on the positive and negative input ends of the comparator. The error amplifier comprises a negative input end for receiving a second reference voltage, a positive input end for receiving a voltage divided from the output voltage source, an output end, and an enable end coupled to the output end of the comparator for receiving the current limit control signal and enabling the error amplifier to generate the current control signal according to the current limit control signal. The error amplifier outputs the current limit control signal through the output end of the error amplifier according to the second reference voltage and the voltage divided from the output voltage source. The first channel aspect ratio is higher than the second channel aspect ratio.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
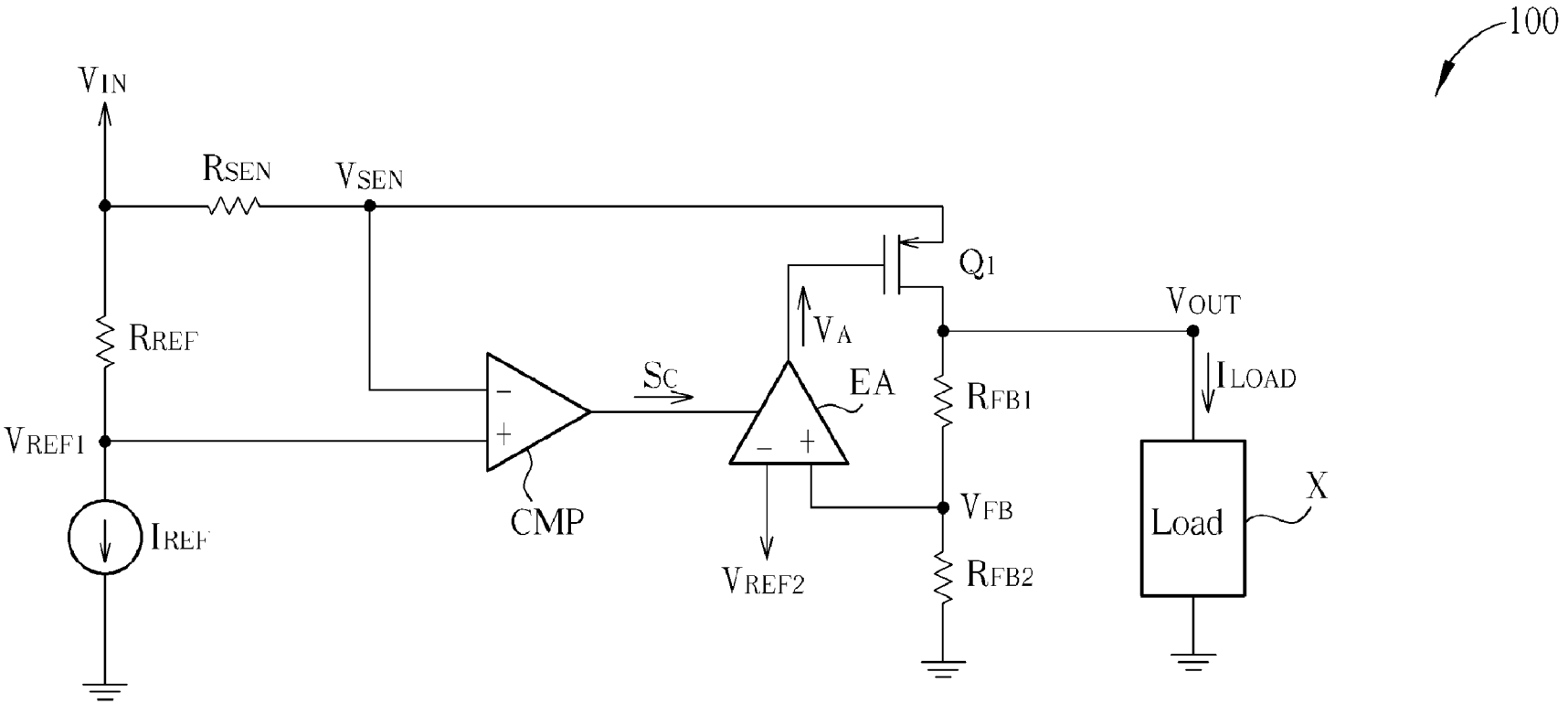
FIG. 1 PRIOR ART
FIG. 1 is a diagram illustrating a conventional LDO regulator.
Figure 2:
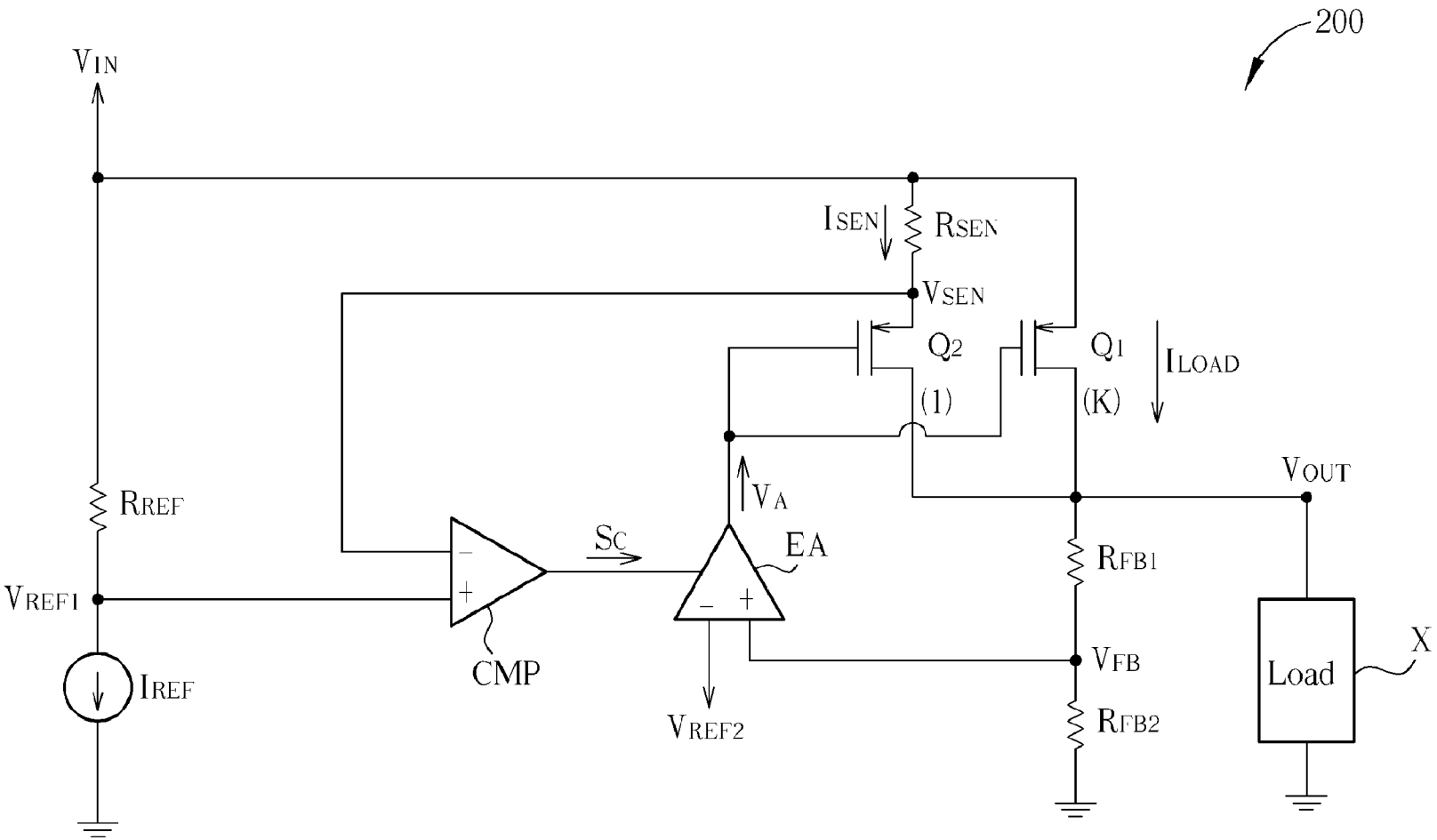
FIG. 2 is a diagram illustrating the LDO regulator with over-current protection of the present invention.

Please refer to FIG. 2. FIG. 2 is a diagram illustrating the LDO regulator 200 with over-current protection of the present invention. As shown in FIG. 2, the LDO regulator 200 comprises a sensing resistor $R_{SEN}$, a reference resistor $R_{REF}$, two feedback resistors $B_{FB1}$ and $R_{FB2}$, a reference current source $I_{REF}$, a comparator CMP, an error amplifier EA, and two transistors $Q_1$ and $Q_2$. The transistors $Q_1$ and $Q_2$ are PMOS transistors, and the channel aspect ratio of the transistor $Q_1$ is K times the channel aspect ratio of the transistor $Q_2$ (K>1).

The LDO regulator 200 is used to convert an input voltage source $V_{IN}$ to an output voltage source $V_{OUT}$ for providing the output voltage $V_{OUT}$ and the loading current $I_{LOAD}$ to the load X. The detail of the operation principles is explained as follows.

The feedback resistors $R_{FB1}$ and $R_{FB2}$ are coupled between the output voltage source $V_{OUT}$ and a ground end for providing the feedback voltage $V_{FB}$ divided from the output voltage $V_{OUT}$ to the error amplifier EA. The error amplifier EA comprises a positive input end for receiving the feedback voltage $V_{FB}$, a negative input end for receiving a reference voltage $V_{REF2}$, and an output end for outputting the current control signal $V_A$ according to the signals received on the positive and negative input ends of the error amplifier EA. The control end (gate) of the transistor $Q_1$ is coupled to the output end of the error amplifier EA for receiving the current control signal $V_A$. The transistor $Q_1$ controls the output voltage $V_{OUT}$ and the loading current $I_{LOAD}$ according to the magnitude of the current control signal $V_A$. More particularly, when the current control signal $V_A$ is lower, the loading current $I_{LOAD}$ is higher; otherwise, when the current control signal $V_A$ is higher, the loading current $I_{LOAD}$ is lower. Therefore, when the feedback voltage $V_{FB}$ is lower than the reference voltage $V_{REF2}$ (for example, when the loading current drained by the load X increases), the current control signal $V_A$ outputted from the error amplifier EA turns on the transistor $Q_1$ more for raising the output voltage $V_{OUT}$. In other words, the voltage of the current control signal $V_A$ is decreased.

Besides, the control end (gate) of the transistor $Q_2$ is further coupled to the output end of the error amplifier EA for receiving the current control signal $V_A$ and thus the transistor $Q_2$ provides the sensing current $I_{SEN}$ accordingly. However, the channel aspect ratio of the transistor $Q_2$ is much smaller than that of the transistor $Q_1$ (1:K, where K is much larger than 1). Therefore, when the actual loading current drained by the load X is calculated, the sensing current $I_{SEN}$ is ignorable and only the loading current $I_{LOAD}$ is calculated.

The reference resistor $R_{REF}$ is coupled between the input voltage source $V_{IN}$, the reference current source $I_{REF}$, and the positive input end of the comparator CMP for providing a reference voltage $V_{REF1}$ to the comparator CMP. The sensing resistor $R_{SEN}$ is coupled between the input voltage source $V_{IN}$, the negative input end of the comparator CMP, and the first end (source) of the transistor $Q_2$ for providing a sensing voltage $V_{SEN}$ to the comparator CMP. The comparator CMP generates a current limit control signal $S_C$ by comparing the magnitudes of the reference voltage $V_{REF1}$ and the sensing voltage $V_{SEN}$. That is, when the sensing voltage $V_{SEN}$ is higher than the reference voltage $V_{REF1}$, the current limit control signal $S_C$ is logic "0" (low voltage level); otherwise, when the sensing voltage $V_{SEN}$ is lower than the reference voltage $V_{REF1}$, the current limit control signal $S_C$ is logic "1" (high voltage level). Since the sensing resistor $R_{SEN}$ is serial-connected between the input voltage source $V_{IN}$ and the transistor $Q_2$, consequently, the magnitude of the sensing current $I_{SEN}$ can be derived from the values of the sensing voltage $V_{SEN}$ and the sensing resistor $R_{SEN}$ so that the magnitude of the loading current $I_{LOAD}$ ($I_{SEN}$:$I_{LOAD}$=L:K) can be calculated and limited by the comparator CMP. More particularly, when the sensing voltage $V_{SEN}$ is lower than the reference voltage $V_{REF1}$, which means that the sensing current $I_{SEN}$ is higher than a current limit ($(1/K)\times I_{LIMIT}$) and the loading current $I_{LOAD}$ is higher than the current limit $I_{LIMIT}$, the comparator CMP outputs the current limit control signal $S_C$ with logic "1" to the error amplifier EA for stopping the error amplifier EA operating. In other word, when the current limit control signal $S_C$ is logic "1", the error amplifier EA is disabled and therefore is not capable of keeping decreasing the current control signal $V_A$. In this way, when the error amplifier EA receives the current limit control signal $S_C$ with logic "0", the error amplifier EA is able to adjust the voltage of the current control signal $V_A$; otherwise, when the error amplifier EA receives the current limit control signal $S_C$ with logic "1", the error amplifier EA is not able to adjust the voltage of the current control signal $V_A$. By such manner, the levels of the transistors $Q_1$ and $Q_2$ being turned on are limited by the current control signal $V_A$ outputted from the error amplifier EA and therefore the magnitudes of the sensing current $I_{SEN}$ and loading current $I_{LOAD}$ are limited as well.

The advantage of the LDO regulator of the present invention is that the sensing resistor $R_{SEN}$ is serial-connected with the transistor $Q_2$ instead of the transistor $Q_1$. Therefore, the equivalent resistance between the input voltage source $V_{IN}$ and output voltage source $V_{OUT}$ does not include the sensing resistor $R_{SEN}$, which is lower than the conventional LDO regulator. Therefore, the power waste between the input voltage source $V_{IN}$ and the output voltage $V_{OUT}$ is reduced, and the temperature rising caused by the power waste of the LDO regulator is reduced as well, providing great convenience to users.

Those skilled in the art will readily observe that numerous modifications and alterations of the device and method may be made while retaining the teachings of the invention.

What is claimed is:

1. A Low Drop-Out (LDO) regulator with over-current limit, comprising:

a first transistor with a first channel aspect ratio, comprising:

a first end, coupled to an input voltage source;

a second end for generating an output voltage source; and a control end for receiving a current control signal to control current of the output voltage source generated from the second end of the first transistor;

a sensing resistor, coupled to the input voltage source;

a second transistor with a second channel aspect ratio, comprising:

a first end, coupled to the sensing resistor;

a second end, coupled to the second end of the first transistor; and a control end for receiving the current control signal;

a comparator, comprising:

a positive input end for receiving a first reference voltage;

a negative input end, coupled to the sensing resistor for receiving a sensing voltage; and an output end for outputting a current limit control signal according to signals received on the positive and negative input ends of the comparator; and an error amplifier, comprising:

a negative input end for receiving a second reference voltage;

a positive input end for receiving a voltage divided from the output voltage source;

an output end, the error amplifier outputting the current limit control signal through the output end of the error amplifier according to the second reference voltage and the voltage divided from the output voltage source; and an enable end, coupled to the output end of the comparator for receiving the current limit control signal and enabling the error amplifier to generate the current control signal according to the current limit control signal;

wherein the first channel aspect ratio is higher than the second channel aspect ratio.

2. The LDO regulator of claim 1, wherein when the first reference voltage is lower than the sensing voltage, the current limit control signal is at a low voltage level; when the first reference voltage is higher than the sensing voltage, the current limit control signal is at a high voltage level.

3. The LDO regulator of claim 2, wherein when the current limit control signal is at the low voltage level, the error amplifier is able to adjust a voltage of the current control signal according to the second reference voltage and the voltage divided from the output voltage source.

4. The LDO regulator of claim 2, wherein when the current limit control signal is at the high voltage level, the error amplifier is disabled to adjust a voltage of the current control signal.

5. The LDO regulator of claim 1, further comprising:

a first resistor, coupled to the output voltage source; and a second resistor, coupled between the first resistor and a ground end, and coupled to the positive input end of the error amplifier for providing the voltage divided from the output voltage source.

6. The LDO regulator of claim 1, wherein when a voltage of the current control signal is lower, current of the output voltage source outputted from the first transistor is higher; when the voltage of the current control signal is higher, the current of the output voltage source outputted from the first transistor is lower.

7. The LDO regulator of claim 1, wherein the first and the second transistors are P channel Metal Oxide Semiconductor (PMOS) transistors.

8. The LDO regulator of claim 1, further comprising:

a reference resistor, coupled between the input voltage source and the positive input end of the comparator; and a reference current source, coupled between the reference resistor and a ground end;

wherein the reference resistor is used to provide the first reference voltage.

* * * * *